US007260910B2

(12) United States Patent
Danielson

(10) Patent No.: US 7,260,910 B2
(45) Date of Patent: Aug. 28, 2007

(54) LASER GUNSIGHT SYSTEM FOR A FIREARM HANDGRIP

(75) Inventor: Lewis Danielson, Portland, OR (US)

(73) Assignee: Crimson Trace Corporation, Wilsonville, OR (US)

( * ) Notice: Subject to any disclaimer, the term of this patent is extended or adjusted under 35 U.S.C. 154(b) by 0 days.

(21) Appl. No.: 11/043,856

(22) Filed: Jan. 25, 2005

(65) Prior Publication Data

US 2006/0162225 A1 Jul. 27, 2006

(51) Int. Cl.
*F41G 1/00* (2006.01)
*F41G 1/34* (2006.01)

(52) U.S. Cl. ..... 42/117; 42/114; 362/114

(58) Field of Classification Search ..... 42/117, 42/114; 362/114
See application file for complete search history.

(56) References Cited

U.S. PATENT DOCUMENTS

| | | | | |
|---|---|---|---|---|
| 5,177,309 | A | 1/1993 | Willoughby et al. | |
| 5,400,540 | A * | 3/1995 | Solinsky et al. | 42/115 |
| 5,435,091 | A | 7/1995 | Toole et al. | |
| 5,481,819 | A | 1/1996 | Teetzel | |
| 5,557,872 | A * | 9/1996 | Langner | 42/117 |
| 5,581,898 | A | 12/1996 | Thummel | |
| 5,622,000 | A | 4/1997 | Marlowe | |
| 5,704,153 | A | 1/1998 | Kaminski et al. | |
| 5,706,600 | A | 1/1998 | Toole et al. | |
| 5,813,159 | A | 9/1998 | Kay et al. | |
| 5,822,905 | A | 10/1998 | Teetzel | |
| 5,867,930 | A | 2/1999 | Kaminski et al. | |
| 5,896,691 | A | 4/1999 | Kaminski et al. | |
| 6,230,431 | B1 * | 5/2001 | Bear | 42/117 |
| 6,591,536 | B2 | 7/2003 | Houde-Walter et al. | |
| 6,682,350 | B2 | 1/2004 | Kehl et al. | |
| 2003/0029072 | A1 | 2/2003 | Danielson et al. | |

* cited by examiner

*Primary Examiner*—Michael J. Carone
*Assistant Examiner*—Bret Hayes
(74) *Attorney, Agent, or Firm*—Birdwell & Janke, LLP

(57) ABSTRACT

A laser sighting device for a firearm and a method for mounting a laser sighting device on a firearm. A laser sighting device for a firearm comprises a holder adapted to attach to the handgrip of the firearm such that the firearm may be held in a firing position by the handgrip with the device installed thereon, the holder including a first compartment for receiving a laser and holding the laser so as to propagate a beam of light substantially in the muzzle direction of the firearm, and a second compartment for receiving a battery to power the laser, a switch for activation of the laser by the user's hand holding the handgrip in firing position, and an electrical circuit disposed within the holder for interconnecting a laser disposed in the first compartment, a battery disposed in the second compartment and the switch.

11 Claims, 3 Drawing Sheets

LASER GUNSIGHT SYSTEM FOR A FIREARM HANDGRIP

FIELD OF THE INVENTION

This invention relates to a laser gunsight system designed to fit the handgrip of a firearm without requiring significant modification of the firearm, the laser gunsight being operable by the user while the firearm is gripped by the handgrip in the firing position.

BACKGROUND

When using firearms, it is often advantageous for the user to be able to quickly and accurately point the firearm at the target. Many devices assisting in the aiming of a firearm are available, including the classic V-sight, peephole sight, 3-dot sight and similar iron-sight structures, as well as telescopic or optical sights. However, when light conditions are poor such as at night, or in darkened rooms of buildings, a sighting device that relies on ambient light is at a disadvantage. Under such conditions, the target may itself be difficult to acquire visually and to follow if it is moving, and gunsights that are lit only by external light sources are less effective due to the need to see them and align them with the already poorly-perceived target at the time of firing the firearm.

Under poor lighting conditions, self-illuminated gunsights such as tritium sights may be used, but again the effectiveness of such sights depends on the user's ability to align them accurately with a possibly poorly-seen or moving target. This is particularly significant to police and military users of firearms, who in the course of their duties may very likely be confronted with a moving, dangerous target under poor lighting conditions. To accommodate such users, sights have been developed wherein a battery-powered laser is used, the laser having been adjusted to illuminate the point of aim of the firearm. When the laser is turned on by the user of the firearm, it shines light in the direction the bullet will travel when the firearm is fired. Thus, the firearm is aimed merely by directing the laser beam towards the target. The laser beam strikes the target and is reflected back to the user's eye, informing the user exactly where the firearm is aimed and thus what the point of impact of a bullet will be if the firearm is fired.

Various laser gunsight systems have been developed for use with firearms that are equipped with a handgrip, such as handguns, or long guns having a buttstock with a "pistol-grip". The handgrip of a handgun is grasped by the user's hand or hands when the firearm is being held in the firing position. With a long gun, i.e., a rifle or a shotgun, equipped with a handgrip or pistol-grip, typically the rear or "trigger" hand holds the handgrip while the front hand holds the forestock when the firearm is in the firing position.

Kaminski, U.S. Pat. Nos. 5,704,153 and 5,867,930, discloses a firearm battery and control module for a gunsight laser wherein the battery and control circuitry are contained within a housing that fits inside the handgrip of a firearm. The stock handgrip, that is, the handgrip that the firearm is normally provided with by the manufacturer, must be replaced with a specially adapted or custom handgrip containing components of the laser gunsight system to allow this system to be used. Willoughby, U.S. Pat. No. 5,177,309, discloses a laser-aimed weapons system in which a small laser unit is attached to the bottom end of a handgun grip. The switch is incorporated in the laser unit and is largely inaccessible to operation when the firearm is in firing position. Houde-Walter, U.S. Pat. No. 6,591,536, discloses a laser assembly that is mounted on the side of a handgun frame above the trigger, the switch being contained in the unit and typically operated by the user's trigger finger. Teetzel, U.S. Pat. No. 5,481,819, discloses a laser sight that may be used on a handgun, the switch and circuitry for which is located inside modified custom handgrips that replace the stock handgrips supplied with the firearm. Toole et al., U.S. Pat. No. 5,706,600 discloses a laser sight that may be used on a handgun wherein the laser is disposed forward of the trigger guard, a switch is disposed below the trigger guard and a power supply is disposed within the handgrip of the firearm. Toole, et al., U.S. Pat. No. 5,435,091, discloses a laser sight disposed at the top of the handgrip rearward of the trigger wherein the power supply and circuitry is contained within a customized handgrip.

However, there is a need for a laser sighting system that may be used with stock firearms, not requiring replacement of handgrips, attachment of special rails, or other modifications. Furthermore, a system that can be readily operated by a user with the firearm in firing position, using only the hand gripping the firearm without requiring movement of the hand from the position normally used when aiming and firing the firearm, would be advantageous. It is an object of the present invention to provide a laser gunsight system for firearms, operable by the user with their hand holding the firearm in firing position, not requiring any significant modification of the firearm to allow for installation of the sighting system.

SUMMARY

A laser sighting device for mounting on the handgrip of a firearm and a method for mounting a laser sighting device on a firearm are provided. The device comprises a holder conforming to the shape of and adapted to attach to the handgrip of the firearm such that the firearm may be held in a firing position by the handgrip with the device attached. The holder includes a first compartment for receiving a laser and holding the laser so as to propagate a beam of light substantially in the muzzle direction of the firearm, a second compartment for receiving a battery to power the laser, a switch disposed in the holder for activation of the laser by the user's hand while holding the handgrip in firing position, and an electrical circuit disposed within the holder for interconnecting a laser disposed in the first compartment, a battery disposed in the second compartment and the switch. The holder, switch and circuit are contained within an integrated assembly that may be attached to the handgrip of the firearm without requiring substantial modification of the firearm.

The method for mounting a laser sighting device on the handgrip of a firearm comprises providing a holder conforming to the shape of a portion of the handgrip, mounting a laser in the holder so as to propagate a light beam substantially in the direction of the muzzle of the firearm when the holder is attached to the handgrip of the firearm, and attaching the holder to the handgrip against that portion of the handgrip to which the shape of the holder conforms.

It is to be understood that this summary is provided as a means of generally determining what follows in the drawings and detailed description of the invention and is not intended to limit the scope of the invention. Moreover, the objects, features and advantages of the invention will be more fully understood upon consideration of the following detailed description of the invention taken in conjunction with the accompanying drawings.

DETAILED DESCRIPTION OF PREFERRED EMBODIMENTS

Figure 2:
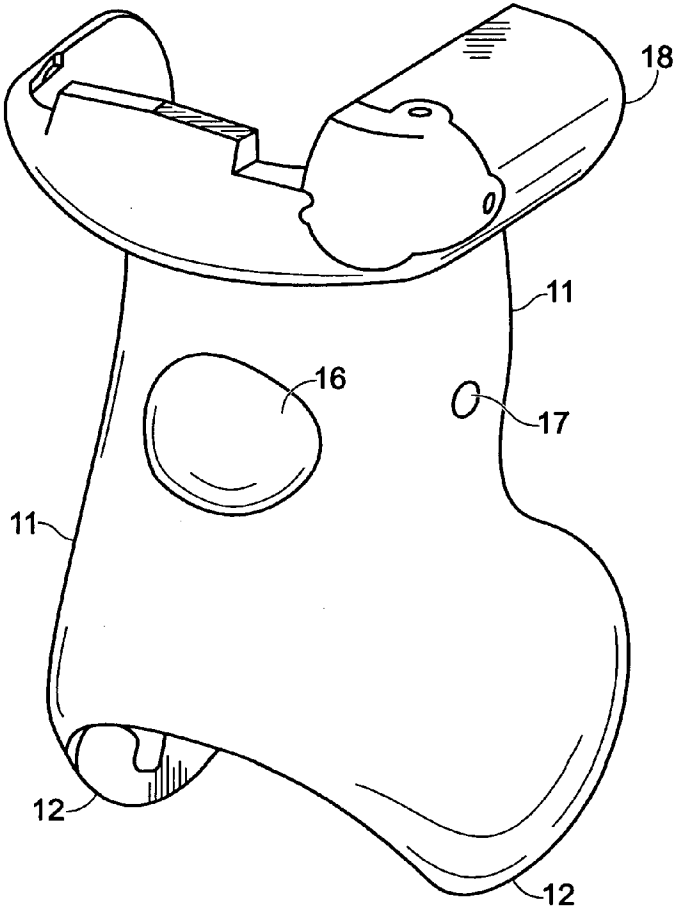
FIG. 2 is a rear view of a preferred embodiment according to the present invention.
Figure 1:
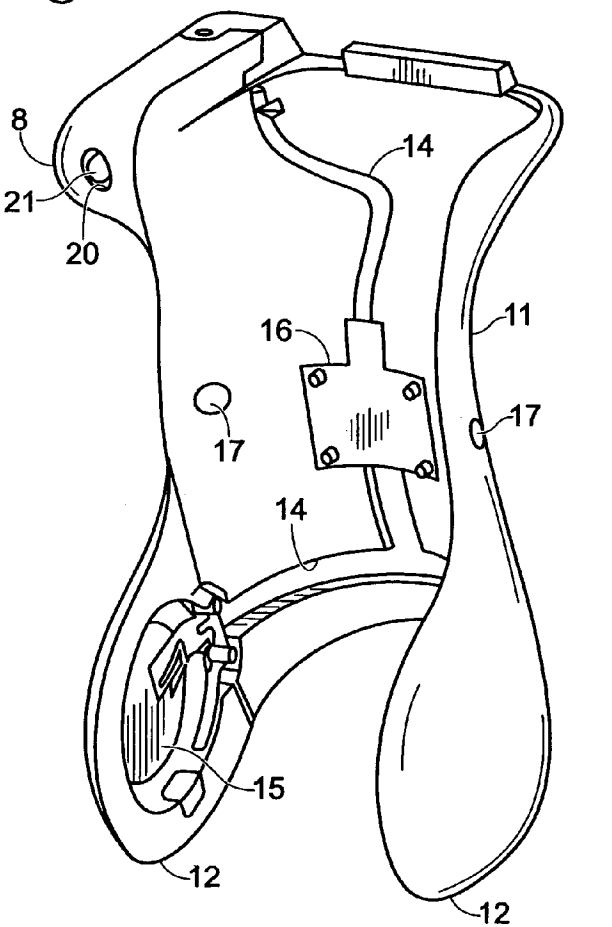
FIG. 1 is a front view of a preferred embodiment according to the present invention.

Referring to FIGS. 1 and 2, a preferred embodiment of the present invention of a laser sighting device includes a holder 10 which preferably comprises a jacket 11 and wings 12. At least one of the wings, and preferably both wings, includes a battery compartment 15 each of which is adapted to receive a battery. The holder further comprises a membrane circuit 14, a switch 16, two holes 17 one on each side of the jacket adapted to receive a pin 19 (FIG. 3) to affix the holder to the firearm handgrip, a laser compartment 18 adapted to contain and aim a laser 21, and a laser light port 20. The membrane circuit connects the laser, the switch and the battery or batteries such that the laser will produce a beam of light when provided with electrical power.

The holder 10 is adapted to conform to the shape of the handgrip of the firearm and to attach to the handgrip. More specifically, the holder is adapted to attach to the firearm's handgrip as it comes from the manufacturer without significant alteration or customization. Thus, stock firearms, i.e., firearms as are produced in mass by the manufacturer without customization, are suitable for installation of the laser sighting device according to the present invention. The holder 10 is adapted such that the firearm may be held and fired without interference from the jacket or wings emplaced on the grip. The switch 16, integrated into the holder, may be operated by the user to turn the laser on or off with the firearm held in firing position without requiring significant shifting of the hand position. The laser compartment 18 and the laser 21 are adapted such that the light beam produced by the laser is projected out through the laser light port 20 in the muzzle direction of the firearm, that is, parallel to the bore of the firearm in the direction of the trajectory of a bullet fired from the firearm. Upon activation by means of the switch, the laser beam emitted by the laser illuminates a target at or near where the point of impact would be of a bullet fired from the firearm.

Figure 3:
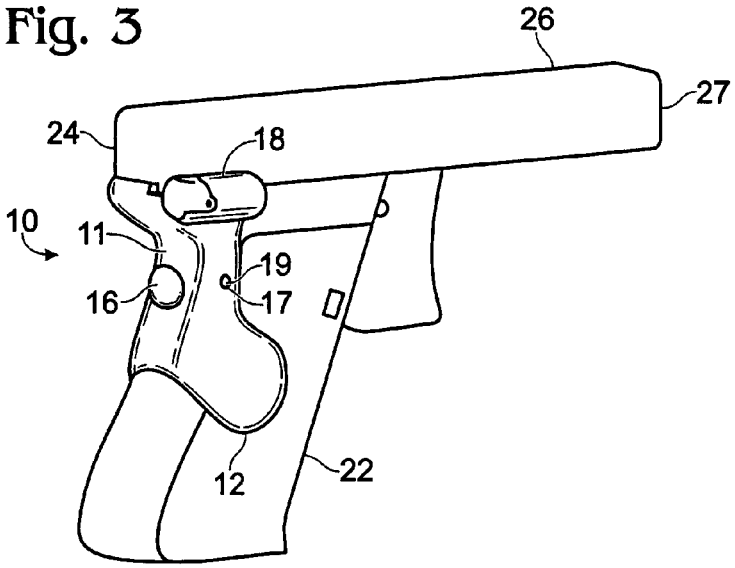
FIG. 3 is a rear view of a preferred embodiment according to the present invention attached to a pistol.
Figure 4:
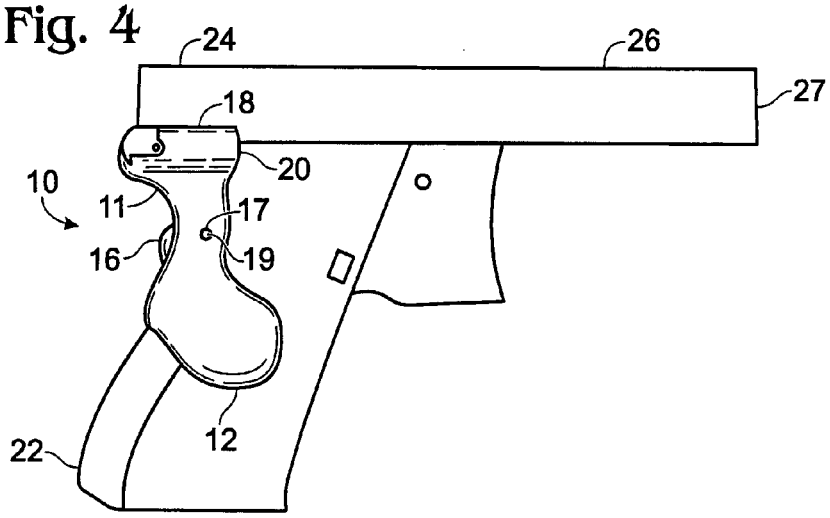
FIG. 4 is a side view of a preferred embodiment according to the present invention attached to a pistol.

Referring to FIGS. 3 and 4, the holder 10 is adapted to conform to the shape of and be attached to the handgrip of a firearm. The firearm, in this example a pistol, includes a handgrip 22, a receiver 24, and a barrel 26, the barrel having a bore which defines the trajectory of a bullet fired by the firearm, terminating in a muzzle 27. A pin 19 extends through the handgrip and into the two holes 17 on the holder 10 to secure the holder in place on the handgrip. The holder 10 is adapted to closely fit the upper portion of the firearm handgrip 22 near where it joins with the receiver 24. As shown in FIG. 1, the front side of the holder that fits the handgrip of the firearm comprises a hollow cavity, the interior wall of which is shaped to closely follow the contours of the handgrip. Different configurations of the handgrip as are present on different models of firearms may be accommodated by altering the shape and dimensions of this cavity during manufacturing of the holder, allowing for the laser sighting device according to the present invention to be installed on a wide variety of firearm makes and models.

The rear side of the holder 10 is preferably closely similar in shape to the firearm's handgrip to which it is attached. However it is shaped, it is adapted to allow the user to comfortably grip the firearm with the holder in place on the handgrip. As is evident from FIG. 4, the holder is thin enough that with it in place on the firearm's handgrip, only minimal alterations of the handgrip's dimensions result such as do not interfere with the normal balance, holding, handling or firing of the firearm.

The holder 10 is preferably formed of a plastic such as nylon which may readily be molded in a variety of configurations, allowing a holder to be designed to fit any of a wide variety of makes and models of firearms. The holder, a specific model of which is designed to fit a specific model of firearm, closely fits the contours of the firearm handgrip. It is secured in place by the use of a pin, but no modification of the firearm's handgrip is required to install the holder. Rather, in this preferred embodiment according to the present invention, a pin already present in the handgrip of the stock firearm is replaced with a slightly longer pin that protrudes from the sides of the handgrip sufficiently to engage the holes 17 of the holder 10. With the pin 19 in place, the holder is prevented from shifting or sliding relative to the handgrip.

Preferably, both wings 12 of the holder include disk-shaped compartments adapted for holding and providing the electrical connections for a pair of disk-shaped batteries. However a holder may be provided with only a single battery compartment without departing from the principles of the invention. Likewise, the battery compartment may be situated in a part of the holder other than the wings without departing from the principles of the invention. The battery or batteries are installed or replaced by removing the holder 10 from the handgrip 22. This is accomplished by withdrawing the pin 19, inserting fresh batteries, returning the holder to its position on the handgrip, and reinserting the pin.

The membrane circuit 14, preferably embedded within the holder 10 or affixed to its inner surface, connects the batteries, the switch 16, and the laser 21 supported within the compartment 18. Any additional circuitry that is required for operation or control of the laser may likewise be embedded in the plastic forming the holder or otherwise positioned within the holder where it will not interfere with the gripping or operation of the firearm.

The switch 16 is emplaced in a position where it may be operated by the hand holding the firearm in a firing position. Preferably, the inner side of the user's thumb or the portion of the user's hand between the thumb and the forefinger rests on or near the switch when the firearm is held in firing position, and the switch is adapted so that it may be operated by pressure provided by that part of the hand. Simply squeezing the grip and applying pressure with the inner side of the thumb or the area between the thumb and the forefinger serves to operate the switch and provide power to the laser turning it on, or removing power from the laser and turning it off. This allows the switch and thus the laser to be operated at will without significant movement of the user's hand away from the normal position employed for aiming and firing the firearm, a useful feature for a user who desires to operate the laser without decreasing readiness to shoot the firearm. When confronted with a potentially dangerous target in a poorly lit area, it is highly advantageous for the user to be able to activate the laser and fire immediately, so that minimal time elapses between the activation of the laser, which serves to give away the user's position, and shooting the firearm.

Figure 5:
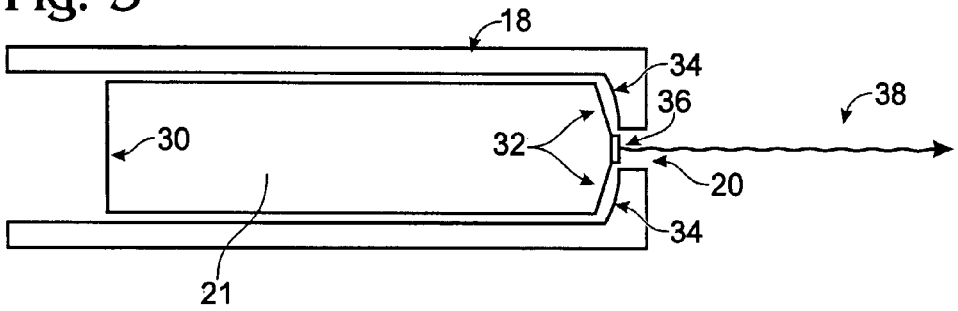
FIG. 5 is a view of a preferred embodiment of a laser installed in a laser support compartment according to the present invention.

FIG. 5 depicts a cutaway view of a laser 21 mounted in a preferred embodiment of the laser compartment 18. The laser compartment preferably is adapted to hold a miniature laser, for example as is described in a concurrent patent application by the same inventors, which is incorporated herein by reference. When the laser 21 is provided with power from the battery, a beam of laser light is emitted by the laser through the laser light port 20 in the muzzle direction of the firearm, i.e., substantially parallel to the bore of the barrel. When the laser is activated, the beam of laser light 38 is preferably emitted through a lens 36 and out through the port 20. Alternatively, no lens may be present.

Thus, the laser light beam illuminates the target at or near what would be the point of impact of a bullet fired from the firearm. The light emitted from the laser may either be visible, typically at the red end of the visible spectrum to reduce the loss of night vision by the user, or it may be infrared light visible only when wearing infrared-sensitive night vision glasses as is known in the art.

Referring to FIG. 5, the laser compartment is adapted to firmly hold the laser in the position in which it is emplaced, providing for a stable relationship between the laser light beam and the axis of the firearm's bore, such that this alignment is not disrupted by shocks such as recoil from firing the weapon. The laser and its compartment are further adapted to allow for small, precise adjustments of the alignment of the laser and thus of the emitted light beam to be made for "sighting in" the firearm. The object of sighting in the firearm is to provide for as close a match as possible between the point on a target illuminated by the laser beam and the point of impact of a bullet fired from the firearm in that position. Preferably, the small, precise adjustments of laser alignment are made by pivoting the laser body about a hemispherical bearing disposed at the front end of the laser compartment. Making slight movements of the rear end 30 of the laser 21 such that a preferably hemispherical concave bearing surface 32 on the front end of the laser pivots on a bearing surface 34 at the front of the compartment causes the laser beam to point in slightly different directions relative to the bore of the firearm. The bearing surface 34 at the front of the compartment may take a form of hemispherical curvature complementary to the curvature of the laser bearing surface 32, but it may take other forms without departing from the principles of the invention. As the laser compartment and the laser it holds are positioned close to the bore of the firearm barrel, parallax is minimized.

Figure 7:
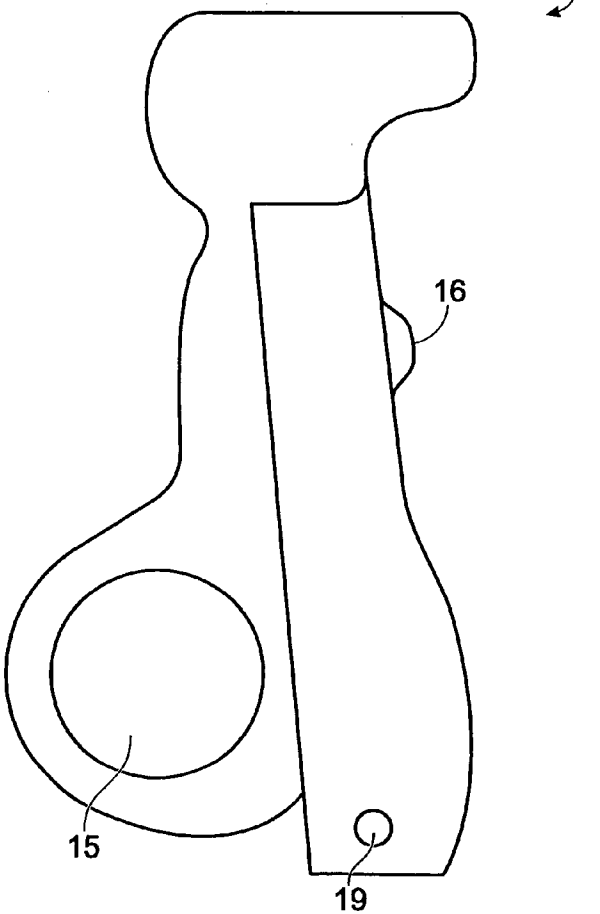
FIG. 7 is a cross-sectional view of the preferred embodiment of FIG. 6 along line A-A thereof.
Figure 6:
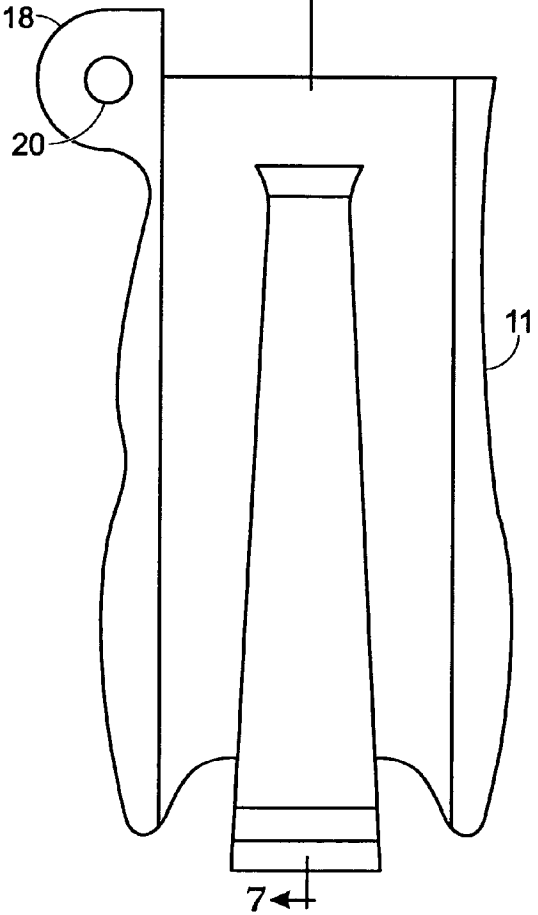
FIG. 6 is a front view of a second preferred embodiment according to the present invention.

In a second preferred embodiment according to the present invention, as shown in FIGS. 6 and 7, the holder 10 comprises the backstrap of a handgrip on a firearm that provides for interchangeable backstraps on its handgrip. Some pistols, such as the Smith and Wesson Model 99, incorporate this feature in order to provide for a grip that can better fit a wider range of hand sizes than is otherwise possible. For example, the Model 99 is available from its manufacturer at the present time with a choice of one of two backstraps of smaller or larger size, to provide a good grip to users with smaller or larger hands respectively. Pistols offered by other manufacturers also incorporate a similar feature. Interchanging the backstraps in all these cases is a trivial operation not requiring modification or customization of the firearm. Typically a pair of pins that hold the backstrap to the handgrip are removed, the existing backstrap is replaced with the replacement backstrap, and the pins are reinserted.

In this second preferred embodiment, holder 10 comprises at least some the components indicated above for the first preferred embodiment including battery compartment 15, switch 16, laser compartment 18 and laser light port 20, but is formed in a shape that closely resembles the shape of any one of the stock backstraps which it replaces when the laser sighting device according to this second preferred embodiment according to the present invention is installed on the given model of pistol. Thus, the same degree of flexibility in accommodating differing hand sizes as is available in the stock firearm of this type when a laser gunsight system according to the present invention is employed with this model of firearm.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

The invention claimed is:

1. A laser sighting device for mounting on the handgrip of a firearm, the handgrip having a front, a back, and two opposing sides, the device comprising:

a holder having a jacket shaped to conform to the shape of a portion of the handgrip and to wrap around the back and over respective portions of the two sides part way toward the front thereof such that the firearm may be held in a firing position by the handgrip with the device attached thereto, said holder further having a first compartment for receiving a laser and holding the laser so as to propagate a beam of light substantially in the muzzle direction of the firearm, and a second compartment for receiving a battery to power the laser;

a switch, disposed in said holder, for activation of said laser by the user's hand holding the handgrip in firing position;

an electrical circuit disposed within said holder for interconnecting a laser disposed in the first compartment, a battery disposed in the second compartment and said switch, said holder, and said circuit comprising a self contained assembly that may be attached to the handgrip, said circuit comprising a membrane circuit; and a mechanism for engaging said holder and the handgrip so as to secure said holder to the handgrip.

2. The device of claim 1, wherein said jacket has an interior surface conforming to the shape of a firearm handgrip, and said membrane circuit is disposed conforming along said interior surface.

3. A laser sighting device for mounting on the handgrip of a firearm, the handgrip having a front, a back, and two opposing sides, the device comprising:

a holder having a jacket shaped to conform to the shape of a portion of the handgrip and to wrap around the back and over respective portions of the two sides part way toward the front thereof such that the firearm may be held in a firing position by the handgrip with the device attached thereto, said holder further having a first compartment for receiving a laser and holding the laser so as to propagate a beam of light substantially in the muzzle direction of the firearm, and a second compartment for receiving a battery to power the laser;

a switch, disposed in said holder, for activation of said laser by the user's hand holding the handgrip in firing position;

an electrical circuit disposed within said holder for interconnecting a laser disposed in the first compartment, a battery disposed in the second compartment and said switch, said holder, and said circuit comprising a self contained assembly that may be attached to the handgrip; and a pin for engaging said holder and the handgrip so as to secure said holder to the handgrip.

4. A laser sighting device for mounting on the handgrip of a firearm, the handgrip having a front, a back, and two opposing sides, the device comprising:

a holder having a jacket shaped to conform to the shape of a portion of the handgrip and to wrap around the back and over respective portions of the two sides part way toward the front thereof such that the firearm may be held in a firing position by the handgrip with the device attached thereto, said holder further having a first compartment for receiving a laser and holding the laser so as to propagate a beam of light substantially in the muzzle direction of the firearm, and a second compartment for receiving a battery to power the laser;

a switch, disposed in said holder, for activation of said laser by the user's hand holding the handgrip in firing position, said switch being imbedded in said jacket and said jacket including a flexible membrane disposed over the switch for activation thereof by pressure on said membrane from the hand of a user;

an electrical circuit disposed within said holder for interconnecting a laser disposed in the first compartment, a battery disposed in the second compartment and said switch, said holder, and said circuit comprising a self contained assembly that may be attached to the handgrip; and a mechanism for engaging said holder and the handgrip so as to secure said holder to the handgrip.

5. A laser sighting device for mounting on the handgrip of a firearm, the handgrip having a front, a back, and two opposing sides, the device comprising:

a holder having a jacket shaped to conform to the shape of a portion of the handgrip and to wrap around the back and over respective portions of the two sides part way toward the front thereof such that the firearm may be held in a firing position by the handgrip with the device attached thereto, said holder further having a first compartment for receiving a laser and holding the laser so as to propagate a beam of light substantially in the muzzle direction of the firearm, and a second compartment for receiving a battery to power the laser said holder comprising a backstrap of a handgrip adapted to be releasably attached to a firearm said holder comprising a backstrap of a handgrip adapted to be releasably attached to a firearm;

a switch, disposed in said holder, for activation of said laser by the user's hand holding the handgrip in firing position;

an electrical circuit disposed within said holder for interconnecting a laser disposed in the first compartment, a batten disposed in the second compartment and said switch, said holder, and said circuit comprising a self contained assembly that may be attached to the handgrip, said circuit comprising a membrane circuit; and a mechanism for engaging, said holder and the handgrip so as to secure said holder to the handgrip.

6. A laser sighting device for mounting on the handgrip of a firearm, comprising:

a holder conforming to the shape of and adapted to attach to the handgrip of the firearm such that the firearm may be held in a firing position by the handgrip with the device attached thereto, said holder comprising a jacket for placement over a part of the existing handgrip and including a first compartment for receiving a laser and holding the laser so as to propagate a beam of light substantially in the muzzle direction of the firearm, and a second compartment for receiving a battery to power the laser;

a switch, disposed in the holder, for activation of said laser by the user's hand holding the handgrip, in firing position; and an electrical circuit, disposed within said holder for interconnecting a laser disposed in the first compartment, a battery disposed in the second compartment and said switch, said holder, and said circuit comprising a self contained assembly that may be attached to the handgrip, said circuit comprising a membrane circuit.

7. The device of claim 6, wherein said jacket has an interior surface conforming to the shape of the firearm handgrip, and said membrane circuit is disposed conforming along said interior surface.

8. A laser sighting device for mounting on the handgrip of a firearm, comprising:

a holder conforming to the shape of and adapted to attach to the handgrip of the firearm such that the firearm may be held in a firing position by the handgrip with the device attached thereto, said holder comprising a jacket for placement over a part of the existing handgrip and including a first compartment for receiving a laser and holding the laser so as to propagate a beam of light substantially in the muzzle direction of the firearm, and a second compartment for receiving a battery to power the laser, said jacket being attachable to said handgrip by a pin;

a switch, disposed in said holder, for activation of said laser by the user's hand holding the handgrip in firing position; and an electrical circuit, disposed within said holder for interconnecting a laser disposed in the first compartment, a battery disposed in the second compartment and said switch, said holder, and said circuit comprising a self contained assembly that may be attached to the handgrip.

9. A laser sighting device for mounting on the handgrip of a firearm, comprising:

a holder conforming to the shape of and adapted to attach to the handgrip of the firearm such that the firearm may be held in a firing position by the handgrip with the device attached thereto, said holder comprising a jacket for placement over a part of the existing handgrip and including a first compartment for receiving a laser and holding the laser so as to propagate a beam of light substantially in the muzzle direction of the firearm, and a second compartment for receiving a battery to power the laser;

a switch, disposed in the holder, for activation of said laser by the user's hand holding the handgrip in firing position, said switch being embedded in said jacket and said jacket including a flexible membrane disposed over said switch for activation thereof by pressure on said membrane from the hand of the user; and an electrical circuit, disposed within the holder for interconnecting a laser disposed in the first compartment, a battery disposed in the second compartment and said switch, said holder, and said circuit comprising a self contained assembly that may be attached to the handgrip.

10. A laser sighting device for mounting on the handgrip of a firearm, comprising:

a holder conforming to the shape of and adapted to attach to the handgrip of the firearm such that the firearm may be held in a firing position by the handgrip with the device attached thereto, said holder including a first compartment for receiving a laser and holding the laser so as to propagate a beam of light substantially in the muzzle direction of the firearm and a second compartment for receiving a battery to power the laser, said holder comprising a backstrap of a handgrip adapted to be releasably attached to a firearm;

a switch, disposed in said holder, for activation of said laser by the user's hand holding the handgrip in firing position; and an electrical circuit disposed within the holder for interconnecting a laser disposed in the first compartment, a battery disposed in the second compartment and said switch, said holder, and said circuit comprising a self contained assembly that may be attached to the handgrip, said circuit comprising a membrane circuit.

11. A laser sighting device for mounting on the handgrip of a firearm, the handgrip having an upper portion, the device comprising:

a holder conforming to the shape of and adapted to attach to the handgrip of the firearm such that the firearm may be held in a firing position by the handgrip with the device attached thereto, the holder including a first compartment for receiving a laser and holding the laser so as to propagate a beam of light substantially in the muzzle direction of the firearm, and a second compartment for receiving a battery to power the laser, said holder further comprising a jacket for placement over a part of the existing handgrip and having an upper portion that wraps around the upper portion of the back of the handgrip;

a switch, disposed in said holder, for activation of said laser by the user's hand holding the handgrip in firing position; and an electrical circuit, disposed within said holder for interconnecting a laser disposed in the first compartment, a battery disposed in the second compartment and said switch, said holder, and said circuit comprising a self contained assembly that may be attached to the handgrip, the switch being disposed on the interior of the jacket within the upper portion thereof, said circuit comprising a membrane circuit.

* * * * *